US008899441B2

(12) United States Patent
Papanikolaou

(10) Patent No.: US 8,899,441 B2
(45) Date of Patent: Dec. 2, 2014

(54) CUP SLEEVE

(71) Applicant: China USA Direct Source Limited, Hong Kong (HK)

(72) Inventor: Emmanouil Papanikolaou, Hong Kong (HK)

( * ) Notice: Subject to any disclaimer, the term of this patent is extended or adjusted under 35 U.S.C. 154(b) by 27 days.

(21) Appl. No.: 13/726,566

(22) Filed: Dec. 25, 2012

(65) Prior Publication Data

US 2013/0264349 A1 Oct. 10, 2013

(51) Int. Cl.
*B65D 81/38* (2006.01)

(52) U.S. Cl.
USPC ..... 220/737; 220/903; 220/738; 220/739

(58) Field of Classification Search
CPC ..... B65D 81/38; B65D 81/3876; B65D 81/3881; B65D 81/3818; B65D 25/36
USPC ..... 220/739, 737, 738, 903
See application file for complete search history.

(56) References Cited

U.S. PATENT DOCUMENTS

| | | | | |
|---|---|---|---|---|
| 1,920,995 | A * | 8/1933 | Legge | 220/737 |
| 2,965,281 | A * | 12/1960 | Herrmann | 220/737 |
| 6,286,754 | B1 * | 9/2001 | Stier et al. | 229/403 |
| 6,401,927 | B1 * | 6/2002 | Sorensen et al. | 206/562 |

* cited by examiner

*Primary Examiner* — Stephen Castellano

(57) ABSTRACT

The present invention relates to a heat-isolating cup sleeve, which comprises a main body and at least one fixer disposed on the main body and able to be folded inwards to insert between a cup and the cup sleeve. The present invention employs a die-cutting part and folds inwards the die-cutting part to form the fixer similar to a wedge, so as to increase inner tensile forces of the cup sleeve sleeving a cup so that the cup sleeve is in a tensioning state and closely attaches with the cup. Therefore, the cup sleeve is difficult to slide from the cup. When the beverage is cooled, the cup sleeve is conveniently taken down from the cup, and is simple and environmental.

5 Claims, 6 Drawing Sheets

CUP SLEEVE

BACKGROUND

1. Technical Field

The present invention relates to living supplies, and more particularly, to an auxiliary product for holding a cup which is used to fill high-temperature or hot beverages.

2. Description of Related Arts

Beverage shops and/or coffee shops for selling beverages and coffee, usually use paper-cups for customers packing with hot beverages. Generally, walls of the paper-cups are relatively thin and the heat-insulation effect is common. If wanting to drink a cup of hot beverage which is just taken by hands, the cup is very hot and difficult to be held. A common solution is attaching a cup sleeve when selling the hot beverage, and the cup sleeve is made of thin corrugated paper and sleeved in the middle of a cup to be isolated from heat and be conveniently held by hands. However, a problem of the conventional cup sleeve is that, the cup sleeve for isolating from the heat is prone to slide down from an original fit and proper location of the cup to a placing plane when the cup with the cup sleeve is placed on the placing plane, such as dining table, work table or other plane surfaces. Thus, the cup sleeve losses the function for protecting people from being heated by the cup filled with the hot beverage.

When the hot beverage is poured into the cup, the material between the cup and the cup sleeve which should be closely contacted with each other, are thermal-expanded non-uniformly, thus an airflow layer is generated therebetween, and the airflow layer is prone to slide the cup sleeve down from the original-designed proper location. Therefore, it should vigorously sleeve the cup sleeve on the cup before taking up the cup which is filled with the hot beverage, so as to closely clutch the cup sleeve on the cup. However, once the cup is laid down, the cup sleeve is slid to the plane where the cup is placed, and if taking up the cup again, the above actions must be repeated to push the cup sleeve to the original location of the cup, thus it can safely hold the cup filled with the hot beverage. Therefore, when using the conventional cup sleeve, it may not only continuously repeat some actions, but also lean the cup and spill the hot beverage to heat the user himself, or spill the hot beverage to pollute or damage peripheral books, documents, and/or clothing, in the process of pushing the cup sleeve to the original location of the cup which is filled with the hot beverage. This is a very severe problem for the user. In addition, if considering from the business factors, if the user always looks at the cup and continuously adjust the cup and the cup sleeve when carrying on the business conversation or on some social occasions, it is very embarrassing and unpleasant.

A conventional solution method is provided, which is coating viscous glue in the inner of the cup sleeve. The viscous glue is melted when heating, thus when the cup sleeve is sleeved on the cup, the temperature of the hot beverage melt the viscous glue to bond the cup sleeve on the cup. However, a new problem is generated, that is, when the beverage is cooled, the cup sleeve is difficult to be taken out from the cup. Furthermore, if not needing the cup sleeve, the user still needs to take the cup with the cup sleeve, and throw away the cup with the cup sleeve after drink the beverage completely. Therefore, the cup sleeve with the viscous glue is difficult to be taken out, and it is disadvantage to recovery and environmental. The conventional paper cup, the cup cover and the cup sleeve are made of the paper, which may recovery to be used again. The viscous glue is a non-environmental material such that the cup sleeve with the viscous glue adds the non-environmental material in the environmental material. It not only increases the cost, but also is not environmental. Therefore, the present invention is providing a simple and environmental solution to solve the above problems.

SUMMARY

The present invention provides a heat-isolating cup sleeve which is simple in structure and does not need other additional material or matter, to firmly fix the cup sleeve on a cup. The cup sleeve is also easy to be taken down from the cup.

The present invention provides a heat-isolating cup sleeve, which comprises a main body and at least one fixer disposed on the main body and able to be folded inwards to insert between a cup and the cup sleeve.

Preferably, the fixer is a die-cutting part formed on the main body. The fixer comprises at least one severable part pushed inwards by forces, and at least one folded part configured for connecting the severable part with the main body.

Preferably, the fixer is formed by die cutting a delta-shaped region at a bottom of the cup sleeve and inward folding the delta-shaped region.

Preferably, the delta-shaped region has a severable part, and the severable part is divided into two independent parts when pushing inwards the delta-shaped region.

Preferably, the fixer is a hole-shaped die-cutting part disposed on the main body, and the hole-shaped die-cutting part comprises a folded part and a severable part pushed inwards by forces.

Preferably, the hole-shaped die-cutting part is half round-shaped, and comprises an arc portion and a straight-line portion. The arc portion is upward and used as the severable part, and the straight-line portion is downward and used as the folded part.

The cup sleeve of the present invention employs the die-cutting part and folds inwards the die-cutting part to form the fixer similar to a wedge. The die-cutting part is folded inwards, thus it can increase inner tensile forces of the cup sleeve sleeving the cup, so that the cup sleeve is in a tensioning state and closely attaches with the cup. Therefore, the cup sleeve is difficult to slide from the cup. In addition, when the beverage is cooled, the cup sleeve is conveniently taken down from the cup, and is simple and environmental.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention relates to a heat-isolating cup sleeve, which comprises a main body and a fixer disposed on the main body and able to be folded inwards such that the fixer is able to be inserted between the cup sleeve and a cup when the cup sleeve is put on the cup.

Figure 1:
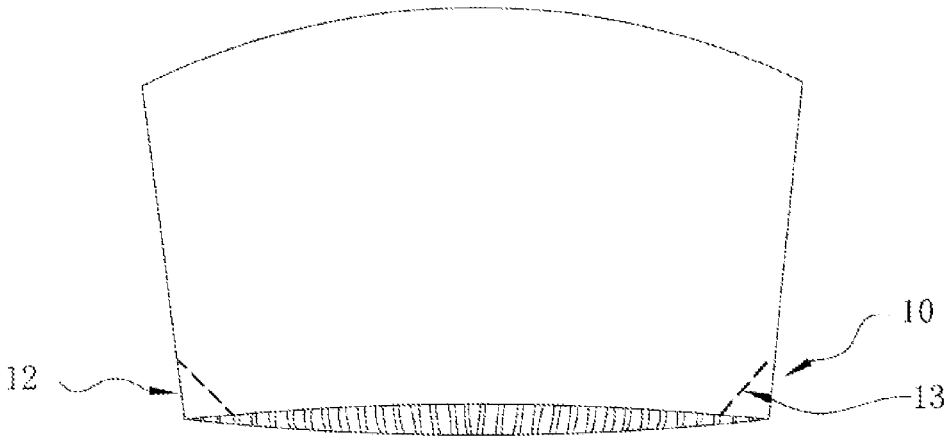
FIG. 1 is a structure view of a cup sleeve in accordance with a first embodiment of the present invention.
Figure 2:
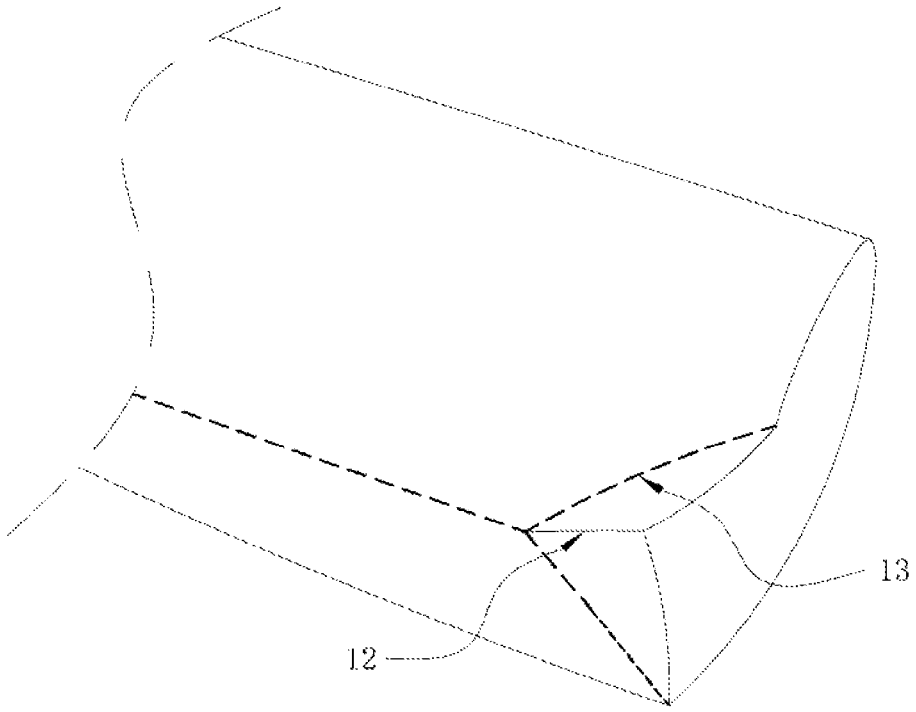
FIG. 2 is a schematic view for showing a folding mode of a fixer of the cup sleeve as shown in FIG. 1.
Figure 3:
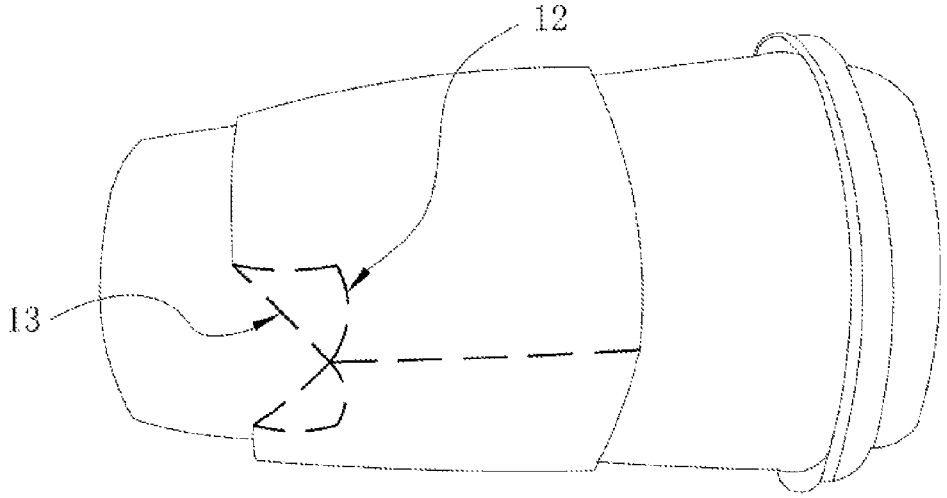
FIG. 3 is a using-state view of the cup sleeve as shown in FIG. 1.

The fixer may be achieved by two following embodiments which have same concepts but are different little with each other. FIG. 1 is a structure view of a cup sleeve in accordance with a first embodiment of the present invention, FIG. 2 is a schematic view for showing a folding mode of a fixer 10 of the cup sleeve as shown in FIG. 1, and FIG. 3 is a using-state view of the cup sleeve as shown in FIG. 1. As shown in FIGS. 1-3, the fixer 10 is formed by die cutting two delta-shaped regions at two ends of the bottom of the cup sleeve and inward folding the delta-shaped regions. Each of the delta-shaped regions has a severable part 12 in the middle of each delta-shaped region. The severable part 12 is pushed inwards by forces to be divided into two independent parts because the severable part 12 bears the overlarge pushing forces. The two independent parts are folded inwards along two corresponding folded parts 13, and the two folded parts 13 are held by hands. Then a cup may slid into the cup sleeve, and the cup sleeve presses the fixer 10 to employ the generated pressing tensile forces, such that the cup sleeve is firmly fixed on the cup and is locked at a proper location where the cup sleeve should be placed. This embodiment shows the two delta-shaped regions, but it is obvious that the amount of the delta-shaped regions is not limited. For example, the present invention may also dispose three delta-shaped regions around the bottom of the cup sleeve.

Figure 4:
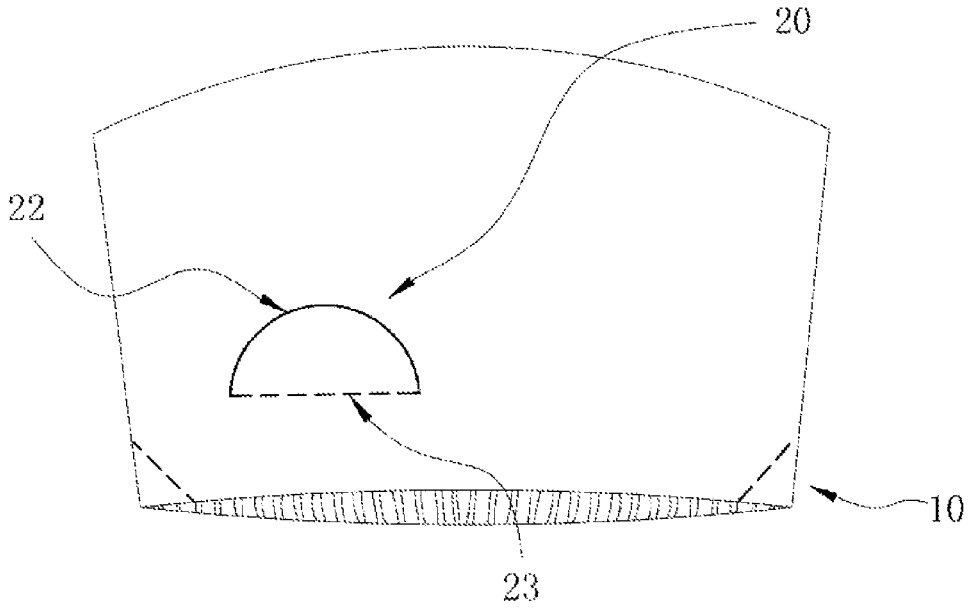
FIG. 4 is a structure view of a cup sleeve in accordance with a second embodiment of the present invention.
Figure 5:
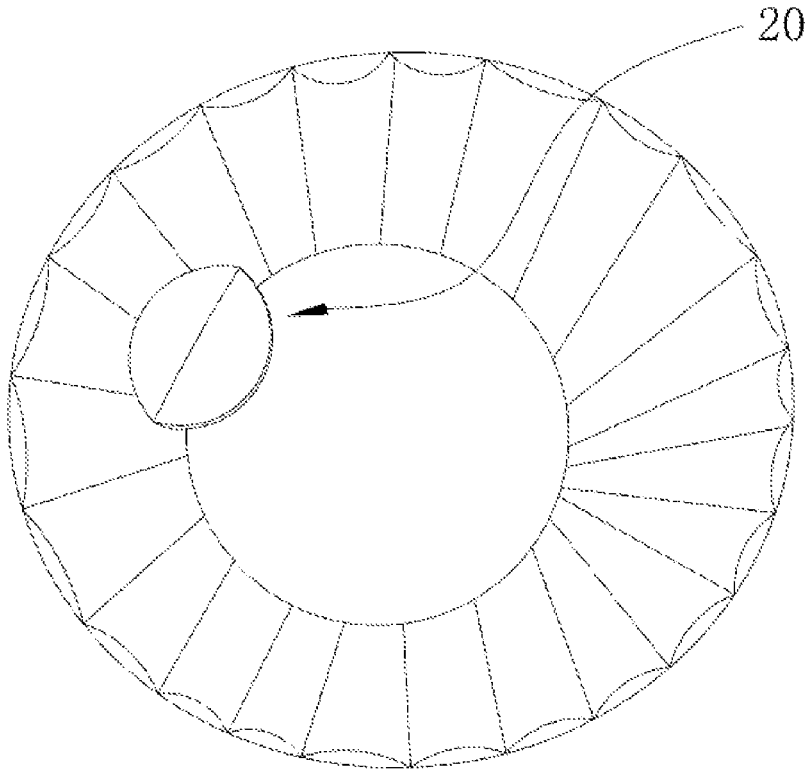
FIG. 5 is a schematic view for showing a folding mode of a fixer of the cup sleeve as shown in FIG. 4.
Figure 6:
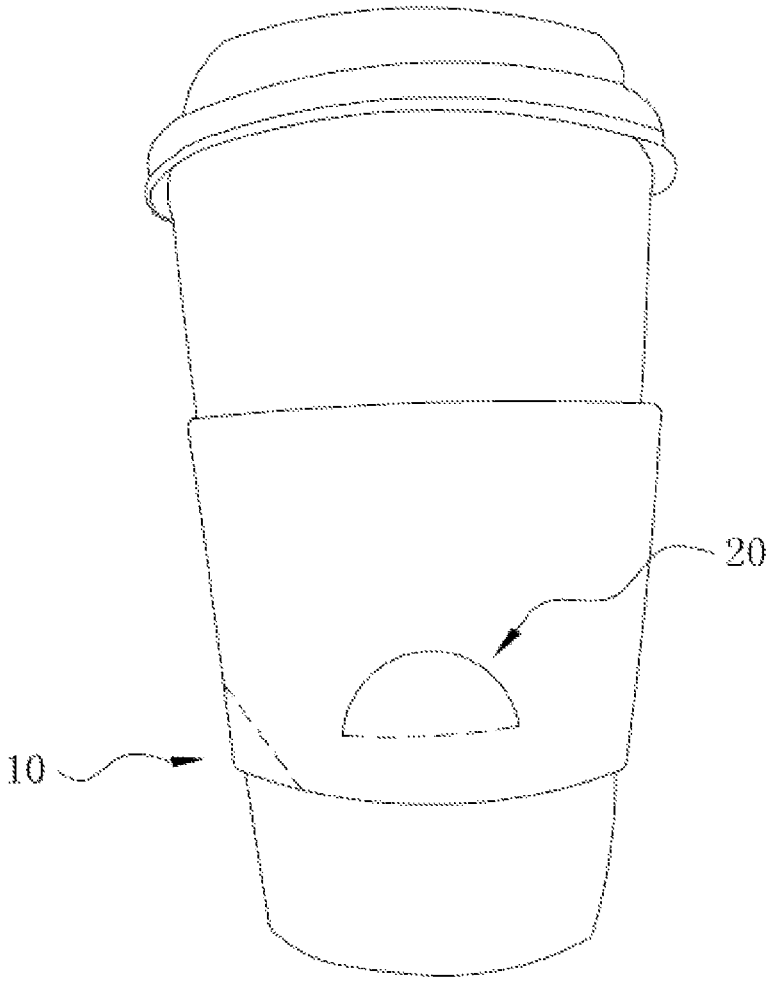
FIG. 6 is a using-state view of the cup sleeve as shown in FIG. 4.

FIG. 4 is a structure view of a cup sleeve in accordance with a second embodiment of the present invention, FIG. 5 is a schematic view for showing a folding mode of a fixer 20 of the cup sleeve as shown in FIG. 4, and FIG. 6 is a using-state view of the cup sleeve as shown in FIG. 4. As shown in FIGS. 4-6, the fixer 20 is formed by disposing a hole-shaped die-cutting part on the main body. The hole-shaped die-cutting part comprises a folded part 23 and a severable part 22 which may be disconnected from the folded part 23 by pushing inwards. The hole-shaped die-cutting part may be rectangle-shaped, sector-shaped, delta-shaped, etc. Preferably, the hole-shaped die-cutting part is half round-shaped and comprises an arc portion and a straight-line portion. The arc portion is upward and used as the severable part 22, and the straight-line portion is downward and used as the folded part 23. The hole-shaped die-cutting part may be disposed at anywhere of the cup sleeve. Preferably, the hole-shaped die-cutting part is disposed adjacent to the bottom of the cup sleeve. When using, the severable part 22 is pushed inwards by forces, and then the severable part 22 is pushed into the inner of the cup sleeve along the folded part 23. When the cup slid in the cup sleeve, the severable part 22 of the cup sleeve which is pushed inwards, is folded downwards in the process of sliding the cup in relation to the cup sleeve, to form a wedge tool, that is the fixer formed between the cup and the cup sleeve. Alternatively, the present invention may employ a plurality of hole-shaped die-cutting part disposed on the main body of the cup sleeve.

When the beverage is cooled and the heat-isolating cup sleeve is not needed, the cup sleeve is convenient to be taken down from the cup and threw away.

Furthermore, as shown in FIGS. 4-6, the cup sleeve may further comprise at least one delta-shaped region, which is same to the first embodiment as shown in FIGS. 1-3. The delta-shaped region has a delta die-cutting line. A severable part 12 is formed in the middle of the delta-shaped region, and may be folded inwards by holding a folded part 13. Then the cup slid into the cup sleeve, and the cup sleeve presses the fixers 10, 20 to employ the generated pressing tensile forces, such that the cup sleeve is firmly fixed on the cup and is locked at the proper location where the cup sleeve should be placed.

That is, as shown in FIGS. 4-6, the cup sleeve may have two different fixers 10, 20, one fixer 10 is a die-cutting region (that is, a delta-shaped region) disposed at the bottom of the cup sleeve, and another fixer is a hole-shaped die-cutting part 20 disposed on the cup sleeve.

The present invention has following advantages:

The present invention may employ several simple actions (such as, pushing, sliding and locking), to make the heat-isolating cup sleeve perform the right function.

The heat-isolating cup sleeve may be locked at the proper location which it should be placed, thus it can prevent the accident and swashing the beverage. Therefore, the present invention provides a safe production.

The cup sleeve of the present invention does not need other additional material, and it is only disposing at least one die-cutting part on the cup sleeve to form at least one wedge tool, that is at least one fixer.

The cup sleeve of the present invention is an environmental solution, which does not add other specific material or matter.

The cup sleeve of the present invention is an economical solution, which does not consume other material cost.

The cup sleeve of the present invention is a comfortable solution, which can solve the problems of the conventional cup sleeve.

In summary, the present invention employs the die-cutting part and folds inwards the die-cutting part to form the fixers 10, 20 similar to the wedge. The die-cutting part are folded inwards, thus it can increase the inner tensile forces of the cup sleeve sleeving the cup so that the cup sleeve is in the tensioning state and the cup sleeve closely attaches with the cup. Therefore, the cup sleeve is difficult to slide from the cup. When the beverage is cooled, the cup sleeve is conveniently taken down from the cup, it is simple and environmental.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A heat-isolating cup sleeve, comprising:

a main body formed into a sleeve having an inner surface and an outer surface, the sleeve adapted to encircle at least a portion of an outer surface of a cup;

a die-cut part formed on the main body, the die-cut part comprises at least one severable part capable of forming a line of separation and at least one foldable part forming a fold line, inward finger pressure on the outer surface of the die-cut part partially separates the die-cut part from the remainder of the main body along the severable part and forces the die-cut part to fold inwardly along the fold line with respect to the outer surface of the remainder of the main body;

when the die-cut part is pushed inwardly and rotated about the fold line, the die-cut part is adapted to be trapped between an inner surface of the main body and the outer surface of the cup and is adapted to form a fixer which wedges between the main body and cup creating a friction fit;

at least a portion of the severable part contacts the remainder of the main body before the severable part is separated.

2. The heat-isolating cup sleeve of claim 1, wherein the die-cut part has an outer periphery in the shape of a triangle.

3. The heat-isolating cup sleeve of claim 1, further comprising a second die-cut part independent of the first die-cut part, the second die-cut part of similar construction having at least one severable part and at least one foldable part and being configured as a mirror image to the first die-cut part, both die-cut parts have outer peripheries in the shape of a triangle, the severable parts of both die-cut parts meet along a vertical line, the die cut parts are adapted to separate from each other along the vertical line.

4. The heat-isolating cup sleeve of claim 1, wherein the die-cut part has an outer periphery in the shape of a semi-circle, the foldable part aligning with the linear portion of the semi-circle and the severable part aligning with an arc or curved portion of the semi-circle.

5. The heat-isolating cup sleeve of claim 4, wherein the die-cut part is surrounded by the remainder of the main body, the semi-circle shape of the die-cut part being positioned with the arc portion upward of the linear portion.

* * * * *